United States Patent [19]

Asaro et al.

[11] Patent Number: 5,014,948

[45] Date of Patent: May 14, 1991

[54] ARTICLE SUPPORT APPARATUS

[76] Inventors: Stanley B. Asaro; Toni J. Asaro, both of 74-607 Gary, Palm Desert, Calif. 92260

[21] Appl. No.: 500,535

[22] Filed: Mar. 26, 1990

[51] Int. Cl.[5] ..... A47B 96/06

[52] U.S. Cl. ..... 248/215; 211/104; 211/86

[58] Field of Search ..... 248/215, 214, 278; 211/86, 104

[56] References Cited

U.S. PATENT DOCUMENTS

| | | | |
|---|---|---|---|
| 1,216,730 | 2/1917 | Quiggle | 248/215 X |
| 1,361,056 | 12/1920 | Hickman | 248/215 |
| 1,389,218 | 8/1921 | Primeau | 211/104 |
| 1,587,676 | 6/1926 | Patterson | 211/104 X |
| 2,151,510 | 3/1939 | Gorfein | 211/86 |
| 2,346,276 | 4/1944 | Reittinger | 248/215 |
| 2,532,255 | 11/1950 | Davis | 248/215 |
| 2,706,049 | 4/1955 | Andrews | 211/86 |
| 2,808,942 | 10/1957 | Harrison et al. | 211/86 |
| 3,653,624 | 4/1972 | Abel | 248/215 X |
| 4,726,607 | 2/1988 | White | 211/86 X |

*Primary Examiner*—Gary L. Smith
*Assistant Examiner*—Suzanne L. Dino
*Attorney, Agent, or Firm*—Leon Gilden

[57] ABSTRACT

An apparatus including a plate-like support member, including a plurality of spaced "U" shaped hooks arranged for securing the plate overlying a support structure such as a door, curtain rod, and the like. A series of equally spaced "J" shaped hooks are mounted to a forward surface of the support plate, and each includes a transversely and integrally mounted horizontal rod mounting a sphere at each end thereof coaxially of the rod. Modifications of the invention include telescoping rods accommodating various articles, as well as selectively removable coverings for the spheres to enhance engagement with articles mounted thereon.

1 Claim, 4 Drawing Sheets

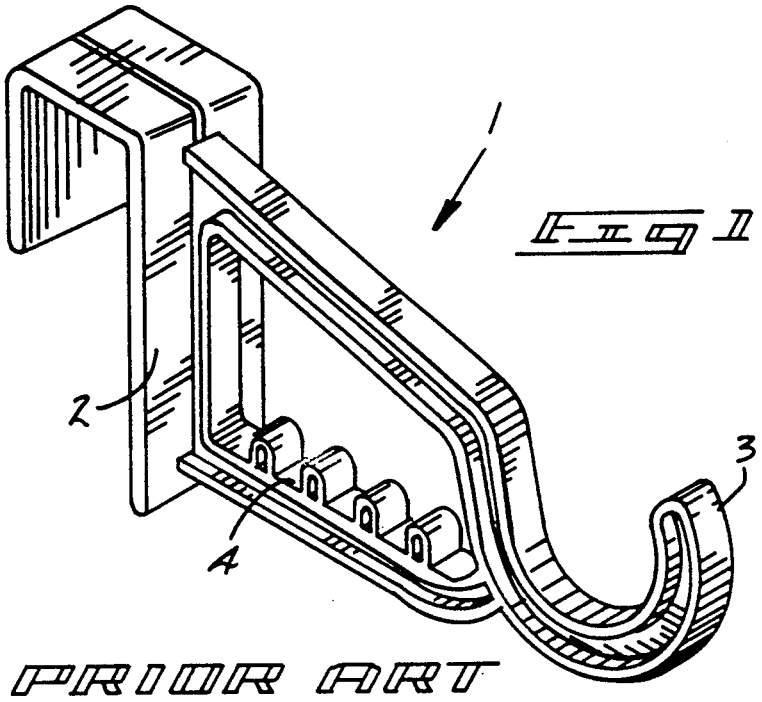
FIG 1
PRIOR ART
FIG 2
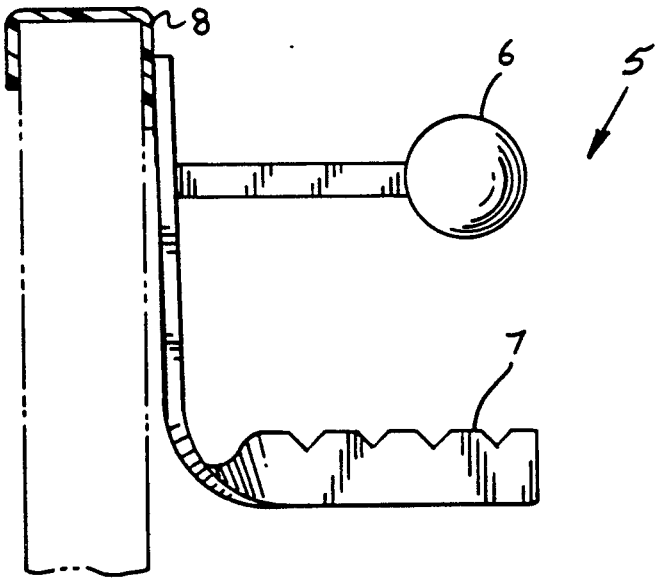
PRIOR ART
FIG 3
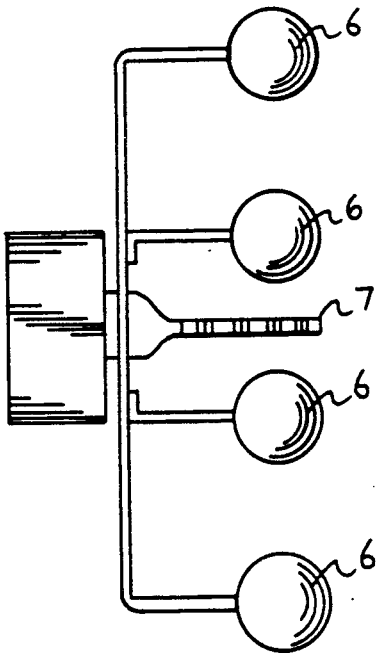
PRIOR ART

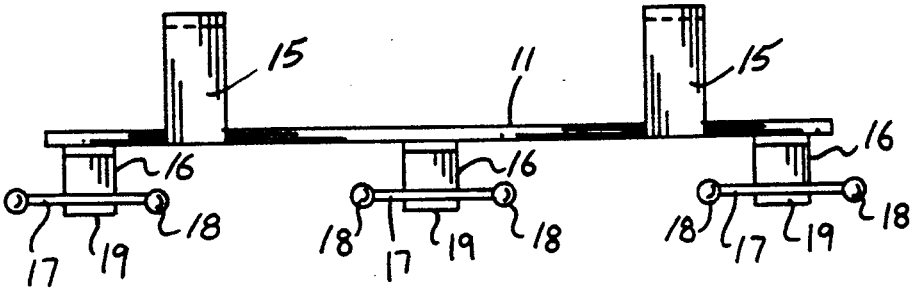
FIG 6
FIG 7
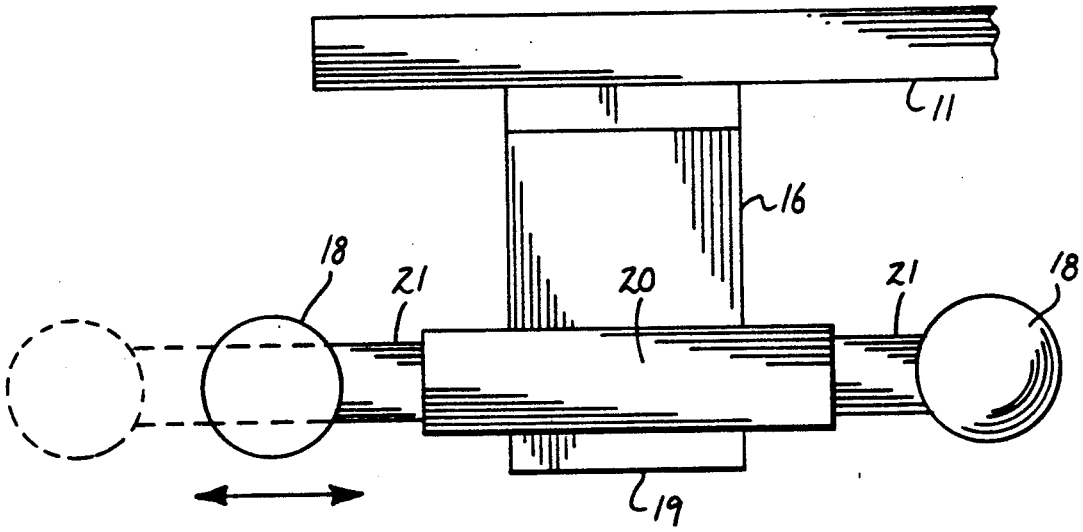

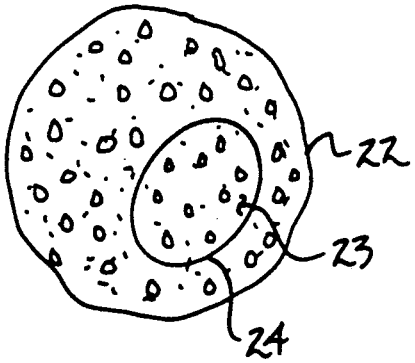
Fig 8
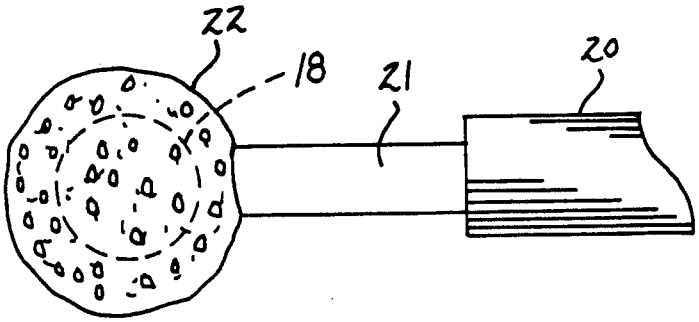
Fig 9
Fig 10
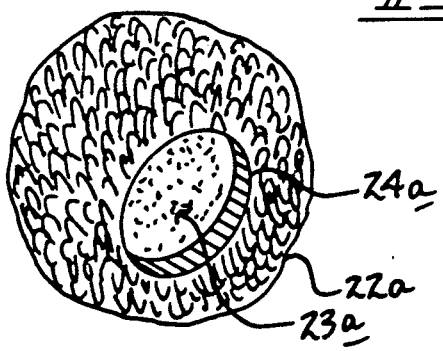

ARTICLE SUPPORT APPARATUS

BACKGROUND OF THE INVENTION

1. Field of the Invention

The field of invention relates to article support apparatus, and more particularly pertains to a new and improved article support apparatus wherein the same is securable and positionable overlying a door support rod framework to enable securement and support of various articles thereon.

2. Description of the Prior Art

The need for support structure in dwellings, and particularly dwellings of limited storage space is required and has been addressed somewhat by the prior art. Such support structure of the prior art has included various hooks to permit accessory storage of articles. The instant invention attempts to overcome deficiencies of the prior art by utilizing an accessory storage apparatus wherein the same is conveniently securable to an existing structural aspect of an associated dwelling, such as a door frame, and is further adjustable to accommodate various classes of articles to be mounted thereon. Examples of the prior art include U.S. Pat. No. 2,736,437 to Boycott setting forth a clothes rack including a plurality of hook members mounted thereon, wherein the hook members are pivotally mounted to the rack to prevent storage of various garments thereon.

U.S. Pat. No. 2,954,954 to Larson sets forth a rack structure with a looped bracket member pivotally mounted thereon to support various articles of clothing thereon.

U.S. Pat. No. Des. 278,106; U.S. Pat No. Des. 193,394; and U.S. Pat No. Des. 279,450 illustrate various hook assemblages arranged for support of various articles thereon.

As such, it may be appreciated that there continues to be a need for a new and improved article support apparatus wherein the same is easily mounted on existing support structure within a dwelling and further accommodates various articles thereon and in this respect, the present invention substantially fulfills this need.

SUMMARY OF THE INVENTION

In view of the foregoing disadvantages inherent in the known types of support structures now present in the prior art, the present invention provides an article support apparatus wherein the same is readily securable within an existing dwelling and is provided with various adjustability to accommodate various classes of articles to be supported thereon. As such, the general purpose of the present invention, which will be described subsequently in greater detail, is to provide a new and improved article support apparatus which has all the advantages of the prior art support and none of the disadvantages.

To attain this, this present invention provides an apparatus including a plate-like support member, including a plurality of spaced "U" shaped hooks arranged for securing the plate overlying a support structure such as a door, curtain rod, and the like. A series of equally spaced "J" shaped hooks are mounted to a forward surface of the support plate, and each includes a transversely and integrally mounted horizontal rod mounting a sphere at each end thereof coaxially of the rod. Modifications of the invention include telescoping rods accommodating various articles, as well as selectively removable coverings for the spheres to enhance engagement with articles mounted thereon.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved article support apparatus which has all the advantages of the prior art support apparatus and none of the disadvantages.

It is another object of the present invention to provide a new and improved article support apparatus which may be easily and efficiently manufactured and marketed.

It is a further object of the present invention to provide a new and improved article support apparatus which is of a durable and reliable construction.

An even further object of the present invention is to provide a new and improved article support apparatus which is susceptible of a low cost of manufacture with regard to both materials and labor, and which accordingly is then susceptible of low prices of sale to the consuming public, thereby making such article support apparatus economically available to the buying public.

Still yet another object of the present invention is to provide a new and improved article support apparatus which provides in the apparatuses and methods of the prior art some of the advantages thereof, while simultaneously overcoming some of the disadvantages normally associated therewith.

Still another object of the present invention is to provide a new and improved article support apparatus wherein the same is readily accommodated within an existing dwelling and further permits securement of various classes of articles thereon.

These together with other objects of the invention, along with the various features of novelty which characterize the invention, are pointed out with particularity in the claims annexed to and forming a part of this disclosure. For a better understanding of the invention, its operating advantages and the specific object attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art article support apparatus.

FIG. 2 is an orthographic side view taken in elevation of a prior art article support apparatus.

FIG. 3 is a top orthographic view of the support apparatus as illustrated in FIG. 2.

FIG. 6 is an orthographic top view of the instant invention.

FIG. 7 is an orthographic top view of a modified support rod structure of the instant invention.

FIG. 8 is an isometric illustration of a resilient covering securable to a support sphere of the instant invention.

FIG. 9 is an orthographic view of the resilient sphere of FIG. 8 mounted to a support sphere.

FIG. 10 is an isometric illustration of a modified support sphere covering utilized by the instant invention.

DESCRIPTION OF THE PREFERRED EMBODIMENT

Figure 4:
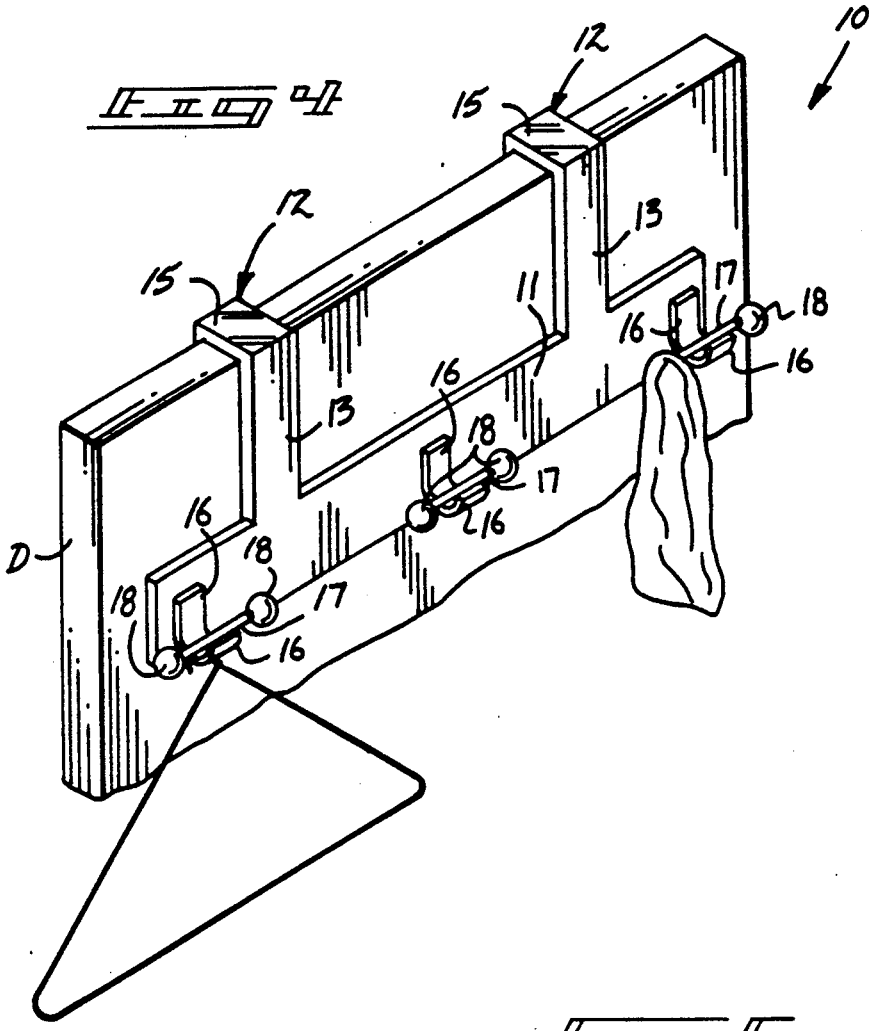
FIG. 4 is an isometric illustration of the instant invention.
Figure 5:
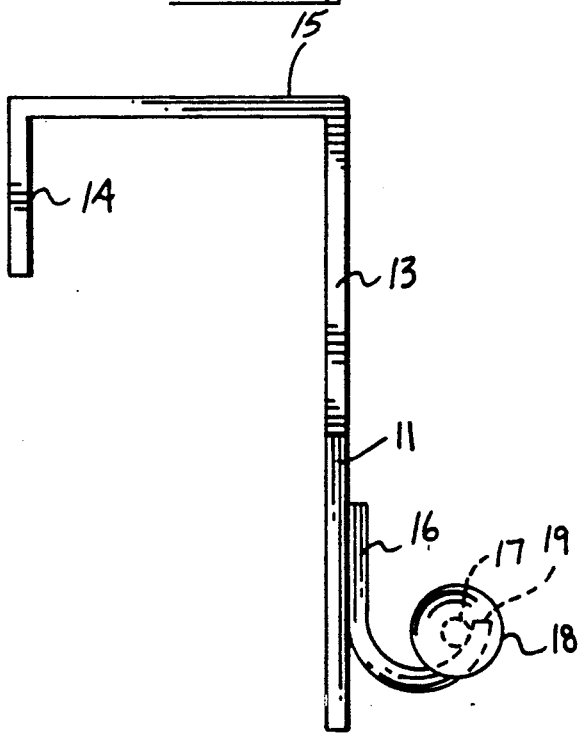
FIG. 5 is an orthographic side view taken in elevation of the instant invention.

With reference now to the drawings, and in particular to FIGS. 1 to 10 thereof, a new and improved article support apparatus embodying the principles and concepts of the present invention and generally designated by the reference numeral 10 will be described.

FIG. 1 illustrates a prior art hook structure 1, including a support bracket 2 with a forward projecting rigid hook member 3 including an underlying interdigited support plate 4. FIGS. 2 and 3 illustrates a further prior art hook structure 5 including a series of support spheres 6 mounted at the end of rigid rods, with an underlying support plate mounted to a support bracket 8 for support to a door structure and the like.

More specifically, the article support apparatus 10 of the instant invention essentially comprises an elongate longitudinally aligned support plate 11 arranged in a horizontal orientation, including a plurality of spaced "U" shaped mounting hangers 12 integrally mounted to and orthogonally directed of the support plate 11. The hangers 12 each includes a forward leg 13 directed upwardly from integral association with an upper edge of the support plate 11 terminating in a base leg 15 extending of the forward leg 13, and including a rear leg 14 arranged parallel to the forward leg 13 directed downwardly from the base leg 15 to permit overlying securement of the organization to a support structure such as a door "D" or a shower curtain rod and the like alternatively. A series of "J" shaped hooks 16 are integrally mounted to a forward surface of the support plate 11 at equally spaced intervals therealong, and each of the hooks 16 includes a forward end 19 spaced forwardly of the support plate 11 defining a concave support cradle structure to receive articles thereon. A horizontal support rod 17 is mounted to the interior concave surface of each of the "J" shaped hooks 16 adjacent to and underlying the forward end 19 and arranged generally parallel to the longitudinal axis defined by the support plate 11. Each of the horizontal support rods 17 includes a support sphere 18 integrally mounted to each terminal end of each support rod 17 coaxially thereof. As illustrated, a variety of articles may be supported upon the articles support apparatus 10 including garment hangers, flexible garments and the like.

FIG. 7 illustrates a modified support rod structure 20 including telescoping legs 21 slidably received through each opposed end of the modified support rod 20. Each telescoping leg 21 includes a support sphere 18 coaxially and integrally mounted to a terminal end of each telescoping leg 21 spaced from the modified support rod 20 to accommodate variously configured garments and articles thereon.

FIGS. 8 and 9 illustrate a resilient memory retentent spherical member 22 including a spherical cavity 23 defined by a complementary configuration defined by a sphere 18, with a resiliently expandable annular opening 24 defined by an expanded diameter substantially equal to that defined by each telescoping leg 21 to provide a secure frictional engaging securement to each of the support spheres 18 in surrounding relationship thereto. The covering spheres 22 provide enhanced frictional engaging surface to provide selective frictional engagement of various articles thereon, such as a garment and the like. FIG. 10 illustrates a modified covering sphere **22*a* including a spherical body, with a cavity 23 therewith of a configuration substantially equal to that as described relative to the cavity 23, with an annular opening 24*a* defined by a diameter substantially equal to the diameter of the telescoping rod 21 in a relaxed configuration, but expandable to permit surrounding securement of each of the resilient modified spheres 22*a* about an associated support sphere 18. The modified covering sphere 22*a* is formed coextensively about its surface, with a hook and loop fastener surface to enhance engagement with various fabric articles to be positioned and supported by the support sphere with the modified covering sphere 22*a*** formed thereon.

As to the manner of usage and operation of the instant invention, the same should be apparent from the above disclosure, and accordingly no further discussion relative to the manner of usage and operation of the instant invention shall be provided. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An article support apparatus comprising, in combination, an elongate longitudinally aligned support plate, the support plate including at least a forward planar face and an upper elongate edge, the upper elongate edge including a plurality of hanger members fixedly mounted thereto, each hanger member including a forward leg aligned in planar alignment with the support plate and each forward plate including a base leg extending rearwardly of the forward leg, and a rear leg extending downwardly relative to each base leg and each rear leg is arranged generally parallel to each forward leg, and a plurality of hook members mounted to the forward face of the support plate, and each hook member including a horizontally aligned support rod fixedly mounted within each hook member, and wherein each hook member is configured of a generally "J" shaped configuration including a forward end defining a concave interior surface, wherein each support rod is fixedly mounted within each concave surface adjacent the forward end arranged generally parallel to the support plate, and wherein each support rod includes a further support rod telescopingly slidable from within each support rod, wherein each further support rod includes a support sphere integrally and coaxially mounted at each terminal end of each further support rod, and wherein each of the further support rods are aligned coextensively relative to one another, and including a first covering sphere selectively securable about each support sphere, wherein the first covering sphere is defined by a resilient memory retentent material and includes an interior spherical cavity substantially complementary to that as defined by the support sphere to complementarily receive the support sphere interiorly of the first covering sphere, and wherein the first covering sphere includes a resilient and expandable annular opening to receive the support sphere therethrough, and with the annular opening defined by an annular opening diameter substantially equal to a diameter defined by the further support rod, and wherein the apparatus further includes a second covering sphere, and wherein the second covering sphere includes a second annular opening equal to the predetermined diameter, wherein the annular opening is in communication with the second covering sphere cavity defined interiorly of the second covering sphere, and wherein the second covering sphere includes a resilient shell, and wherein the resilient shell includes a covering coextensively of an exterior surface of the second covering sphere defined by the hook and loop fasteners.

* * * * *